US007928608B1

(12) United States Patent
Lyons et al.

(10) Patent No.: US 7,928,608 B1
(45) Date of Patent: Apr. 19, 2011

(54) FOR CURRENT VIEWING RESISTOR LOADS

(75) Inventors: Gregory R. Lyons, Tijeras, NM (US); Jay B. Hass, Lee's Summit, MO (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 578 days.

(21) Appl. No.: 12/110,397

(22) Filed: Apr. 28, 2008

(51) Int. Cl.
*H01R 12/00* (2006.01)

(52) U.S. Cl. ..... 307/147; 439/55

(58) Field of Classification Search ..... 307/147, 307/149; 439/55, 59, 60, 63, 66, 75
See application file for complete search history.

(56) References Cited

U.S. PATENT DOCUMENTS 4,621,577 A 11/1986 Bickes, Jr. et al.
5,596,309 A 1/1997 Nabeshima et al.
6,609,925 B1 8/2003 Cannon

*Primary Examiner* — Albert W Paladini
(74) *Attorney, Agent, or Firm* — Arthur N. Trausch; James C. Durkis; John T. Lucas

(57) ABSTRACT

The invention comprises a terminal unit for a flat cable comprising a BNC-PCB connector having a pin for electrically contacting one or more conducting elements of a flat cable, and a current viewing resistor having an opening through which the pin extends and having a resistor face that abuts a connector face of the BNC-PCB connector, wherein the device is a terminal unit for the flat cable.

16 Claims, 6 Drawing Sheets

FOR CURRENT VIEWING RESISTOR LOADS

GOVERNMENT INTEREST STATEMENT

The United States Government has rights in this invention pursuant to Contract No. DE-AC04-94AL85000 between the United States Department of Energy and the Sandia Corporation for the operation of the Sandia National Laboratory.

BACKGROUND

1. Field of the Invention

The present invention relates generally to terminal resistor and to the design of a current viewing resistor loads.

2. Related Art

High energy capacitive discharge units (CDUs) technology, firing and ignition systems, and pulse generator systems have been plagued by the requirement for accurate output loads which tolerate high energy while providing high fidelity current-time measurements. Conventional high power axial resistors do not meet the requirements due to inductance. Many CDUs switch in a nanosecond timeframe yielding thousands of amps of current, which causes a high di/dt multiplier for the rate of current change. A high rate of current change causes problems in achieving accurate readings since a slight leakage in inductance causes a voltage drop.

Conventional current viewing resistors are rugged high frequency resistors designed to sustain the very high peak power and current input. However, conventional designs for high fast current loads require complex manual assembly, which is expensive and error-prone. This leads to a reduction in quality which affects the ability of the load to have a low inductance.

SUMMARY

According to a first broad aspect of the present invention, there is provided a device comprising a BNC-PCB connector having a pin for electrically contacting one or more conducting elements of a flat cable, and a current viewing resistor having an opening through which the pin extends and having a resistor face that abuts a connector face of the BNC-PCB connector. The device may be a terminal unit for the flat cable.

According to a second broad aspect of the present invention, there is provided a device comprising a BNC device comprising a BNC connector mounted on a printed circuit board connector, and the BNC device having a pin for contacting one or more conducting elements of a flat cable and a load. The load comprises a current viewing resistor load having an opening through which the pin extends and having a resistor face that abuts a connector face on the printed circuit board connector and a folded resistor having an opening for receiving the pin and the folded resistor having a connection to the one or more conducting elements. The printed circuit board connector is connected to a grounding element of the flat cable. The device may be a terminal unit for the flat cable.

BRIEF DESCRIPTION OF THE DRAWINGS

The invention will be described in conjunction with the accompanying drawings, in which.

DETAILED DESCRIPTION

The present invention is an improved design of a current viewing resistor (CVR) load that reduces leakage inductance. Embodiments of the present invention may use such design in a terminal unit for a cable, such as a flat or coaxial cable. Such a design of CVR loads may provide increased fidelity for high fast energy dissipating devices, such as CDUs and firing systems. In one embodiment, the CVR load is a disc-shaped resistor that abuts a BNC connector. The CVR has a face which abuts the face of the BNC connector. In some embodiments the face of the CVR occupies substantially the entire portion of the BNC connector face. In some embodiments that use a BNC mounted on a printed circuit board connector (BNC-PCB device), the face of the CVR abuts the BNC-PCB device along the side which is opposite of the BNC connector face. CVRs of the present invention may have an opening for allowing a pin from the BNC to be connected to the grounding and conducting elements of the cable. CVRs may be thin disc-shaped resistor with an opening in the middle to accommodate the pin.

Figure 1:
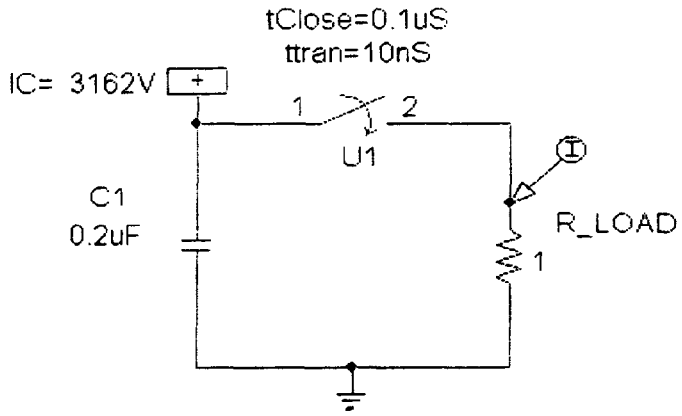
FIG. 1 is a circuit diagram of a CDU having a load.
Figure 2:
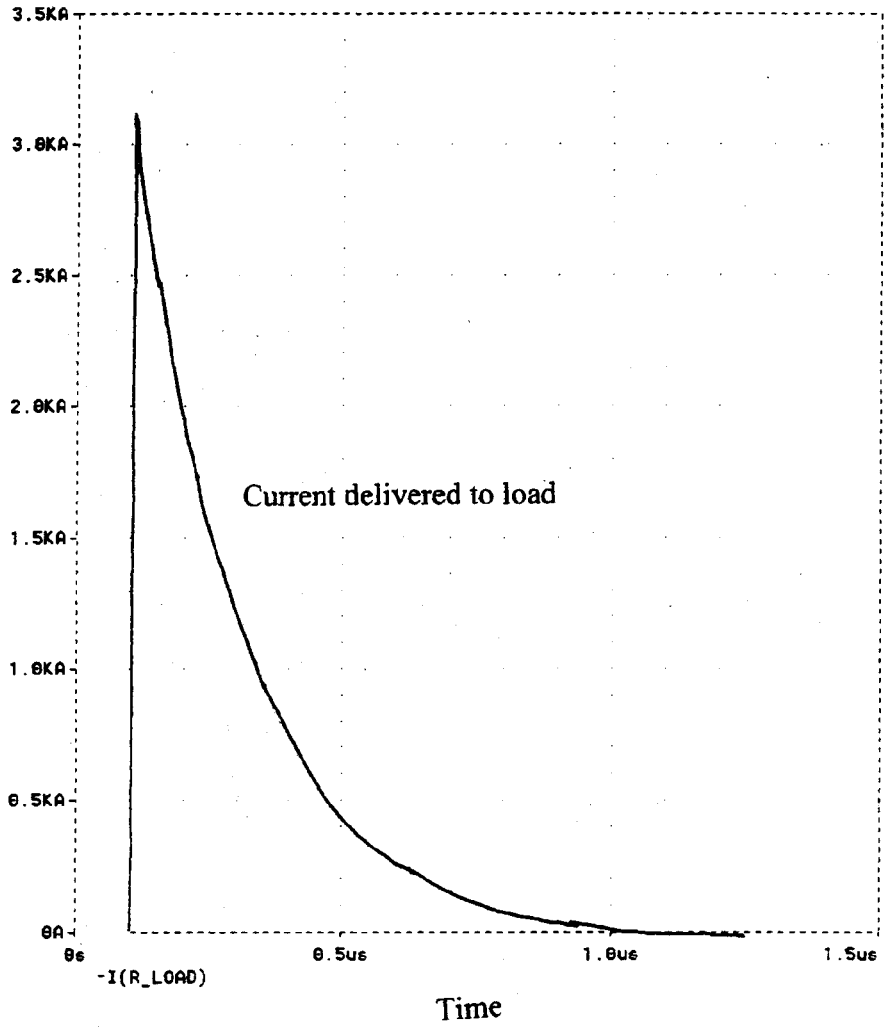
FIG. 2 is a graph showing the rise time of signal in a CDU system.

In some applications, it is desirable for a load for CDUs or firing systems to be designed in a manner such that it is low in inductance. Low inductance gains adequate fidelity. Further, such designs may have the ability to stand up to high pulse power, which is applied through loads when the CDU or firing system is discharged. Since CDU systems switch in a nanosecond timeframe, a slight leakage in inductance may cause a large voltage drop. The circuit of such systems is shown in FIG. 1. A large voltage drop would have an exponential effect on the energy potential of the CDU or firing system. For example, a 0.2 capacitor may be charged to 3162V to deliver approximately 1 joule of energy. The switch opens and closes every 0.1 μsec. Such conditions generate a very fast signal having an approximate rise time of 700 KA/μsec as shown in FIG. 2. A leakage of 1 nH may cause a 700 V drop. Further, a smaller leakage may also cause a voltage drop which is not desirable in a high fidelity load. Along with a voltage drop there is also the consideration that inductance is not resistive and causes a frequency dependent response. Some embodiments of the present invention may be able to provide low inductance that is required by CDU or firing systems.

Further, the embodiments are an improved design over the conventional loads made by hand and attached to BNC connectors. In a conventional load, a NiCr foil is wrapped around a smaller ceramic tube and is mounted in the center of a large frame tube. A CVR may be mounted radially around the frame tube and against the BNC connector along one end. Any reduction in inductance in these conventional loads is due to the fact that all inductance to the frame is in parallel. In contrast the CVR load of the present invention is inexpensive to manufacture and is less complex than conventional loads used BNC connectors. In addition, the CVR load of present invention may be part of a flat cable connected to a BNC connector or a BNC-PCB connector. Such capabilities reduce the overall costs. The embodiments also increase the reliability of the CVR loads since the manufacturing process is less complex. A reliability CVR load may have a greater lifetime of use than unreliability conventional loads.

Figure 3A:
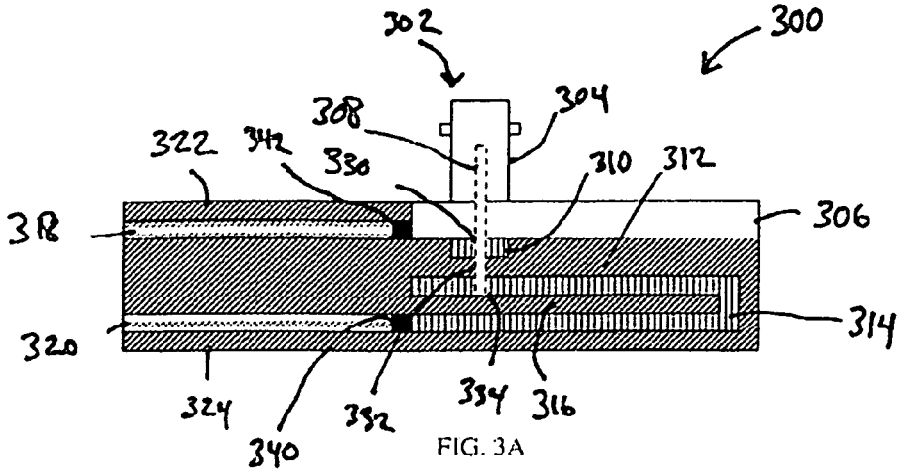
FIG. 3A is cross section view of BNC device attached to a load on the terminal end of a cable in accordance with embodiments of the present invention.
Figure 3B:
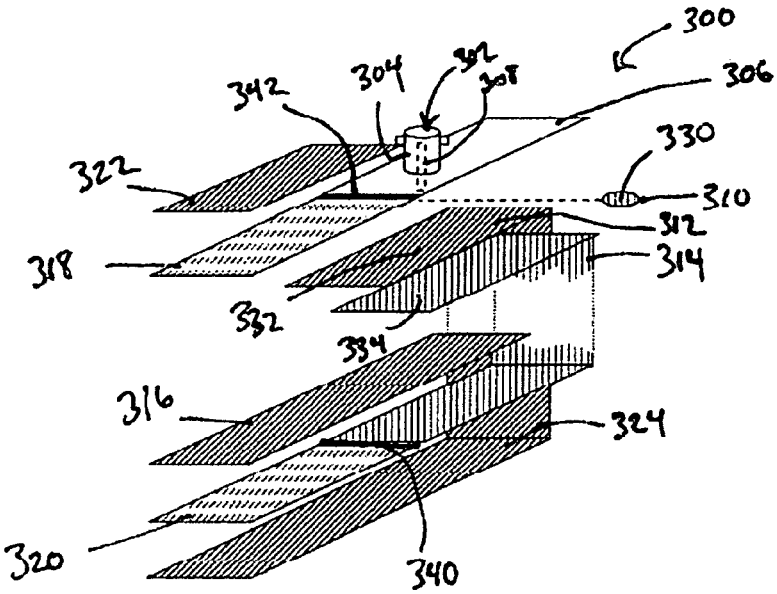
FIG. 3B is an exploded perspective view of the BNC device shown in FIG. 3A.
Figure 3C:
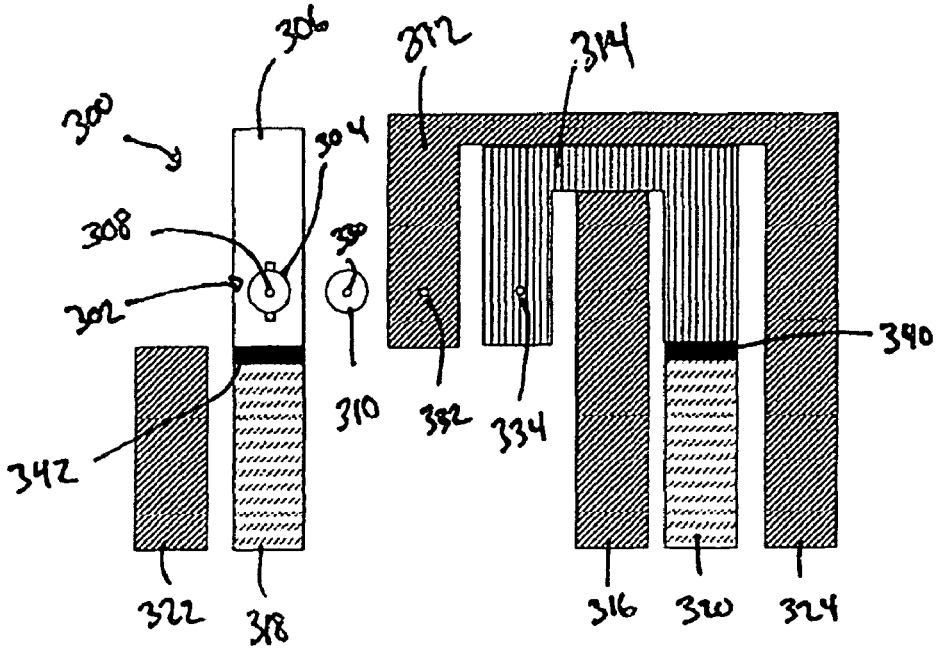
FIG. 3C is an exploded top view of the BNC device shown in FIG. 3A.

FIG. 3A is a cross section view. FIG. 3B is an exploded perspective view, and FIG. 3C is an exploded top view of an exemplary terminal unit 300 of a cable (not shown) according to embodiments of the present invention. Terminal unit 300 comprises a BNC (Bayonet Neill Concelman) device 302 having a BNC jacket 304 mounted on a printed circuit board connector 306 and having a pin 308. A current viewing resistor (CVR) 310 encircles pin 308. CVR 310 has a substantially similar perimeter as the perimeter of BNC jacket 304, which defines a connector face. CVR 310 has a face which abuts printed circuit board connector 306 in the area opposite of the connector face of the BNC device 302. Pin 308 extends through CVR and an insulating layer 312 and into a metal strip resistor 314. Metal strip resistor 314 folds over an insulating layer 316. BNC printed circuit board connector 306 connects to grounding element 318 and metal strip resistor 314 connects to conducting element 320. Insulating layer 322 and 324 surrounds the cable. Pin 308 extends through an opening 330 in CVR 310, opening 332 in insulating layer 312 and opening 334 in metal strip resistor 314. Conducting element 320 and ground conducting element 318 may be gold plated or contain an adhesive in contact areas 340, and 342 for connecting with BNC device 302.

The insulating layers shown in FIGS. 3B and 3C appear as separate layers, while most of the insulating layers in FIG. 3A appear to be an integrated layer. The insulating layers may be formed from separate layers which are combined during manufacturing. Embodiments of the present invention may use a polymeric material such as a polyimide film, or any other material that serves as a high voltage dielectric. In some embodiments, the polyimide film may be Kapton™ made by DuPont or comparable materials.

The resistors shown in FIGS. 3A-3C may be a fixed resistor such as a wire-round resistor, metal-film resistor or composition resistor. Examples of such resistors may be a metal strip resistor such as nichrome (nickel-chromium, NiCr) resistor. A CVR resistor used in some embodiments may have a value of approximately 0.05 to 0.2 ohm. In some embodiments the value of the CVR resistor may approximate 0.010 ohm. A metal strip resistor used in some embodiments may have a value of approximately 0.1 to 3 ohm. In some embodiments the value of the metal strip resistor may approximate 0.250 ohm. Such resistance values may be usable for 0.1 to 2 joules CDU and firing systems.

Figure 4:
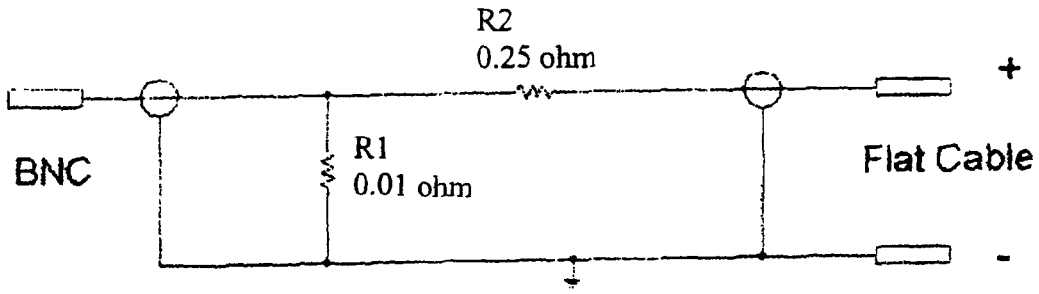
FIG. 4 is a circuit diagram of a CVR load in accordance with embodiments of the present invention.

An electrical circuit of the embodiments of the present invention is shown in FIG. 4. While the basic circuit remains similar, embodiments of the present invention seek to refine manufacturing methods which impacts the design.

Terminal units of the present invention may be used for BNC connectors that connect CDU or firing systems to an instrument device. For example, the terminal unit shown in FIGS. 3A-3C may be part of a flat or coaxial cable which is terminated in a 50 ohm load at an oscilloscope. Such cables may be connected to other suitable instrument devices. The conducting elements, including grounding elements, in the cable may be copper or a copper based alloy.

A metal strip resistor may be folded back upon itself to reduce inductance.

The BNC connector shown in FIGS. 3A-3C may be a male or female device, even though a female BNC device is shown. Various types of pins may be used to connect the male and female BNC connectors. Also, various types of mechanical connections may be used when mating the male and female connectors. In some embodiments, both the male and female BNC device may have a CVR load design of embodiments of the present invention. In such embodiments the perimeter of the jacket may define the area of the connector face, which is usually substantially circular. The connector face is on the away end from the open end of the BNC connector.

In embodiments where the BNC device is mounted on a printed circuit board connector, the combined device forms a BNC-PCB connector. The perimeter of the BNC may still define a connector face, which the face of the CVR abuts. However, in such embodiments the printed circuit board may be interposed between the BNC connector and the face of the CVR.

In addition, other types of connectors may be used in further embodiments of the present invention. Such connectors include TNC connectors.

The connection between the BNC device and CVR may be further enhanced by an electrical adhesive or gold plating on one or more contacting surfaces. In particular, the inner portion of the opening in CVR and metal strip resistor and the pin of the BNC device may be etched and plated in gold or coated in another adhesive material. The additional plating may be used when soldering BNC or the BNC-PCB to the conducting elements of the cable.

Figure 5:
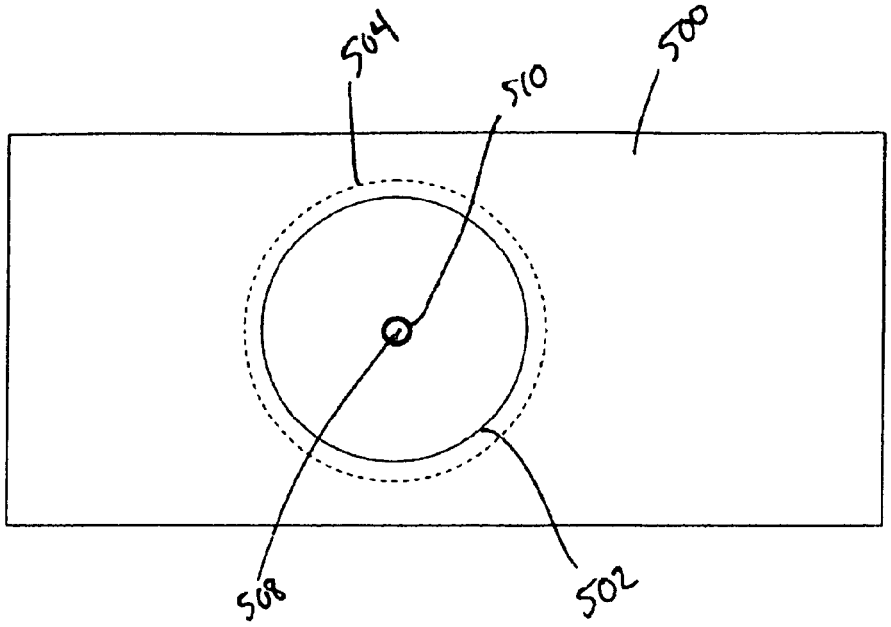
FIG. 5 is a bottom view of a CVR load abutting a connector face of BNC-PCB device in accordance with embodiments of the present invention.

The CVR load shown in FIG. 5 has a substantial similar perimeter as the perimeter of the BNC on a BNC-PCB connector 500. FIG. 5 shows a bottom view of CVR load 502 abutting a connector face 504 of BNC device. Resistor face (not shown) of CVR 502 abuts against connector face 504 of BNC device (not shown). BNC device defines the overall perimeter of connector face 504 and CVR load 502 occupies a substantial portion of that perimeter. BNC device 504 mounts on a PCB connector 506 and the mechanical connector (not shown) of the BNC device extends away from the view. Proximate to the center of CVR load 502 is a pin 508 which extends toward and away from the view. Between pin 508 and CVR load 502 is an adhesive material 510. Such an arrangement as shown in FIG. 5 is different from the convention loads that wrap a resistor radially around the cable.

In embodiments, this perimeter may be a circle or oval and the CVR may be substantially disc-shaped. In such embodiments, the disc shaped CVR may be cut from a plate of NiCr or similar metal resistor. In one embodiment, the dimension of such disc shape CVR has an overall radius of approximately 0.318 cm (0.125 inches) and the opening has an inner radius of approximately 0.051 cm (0.02 inch). The thickness of the CVR may be 0.6 mil. Such a design of a CVR load may have an approximate resistance of 11.67 mohms. The calculated resistance of the disc shaped CVR load is a progressive non-linear resistance which is radial in fashion starting at the opening proximate to the center and expanding to the greater perimeter. In such a design it may be expected that the smaller radius of the inner circles gives higher resistance contribution than the large radius of the perimeter.

In some embodiments the design of CVRs may also include an insulating washer between the PCB connector and CVR. The insulating washer may separate the resistor face and connector face. Such embodiments may use a CVR load having an increased radius to occupy a greater portion or all of BNC perimeter.

Figure 6:
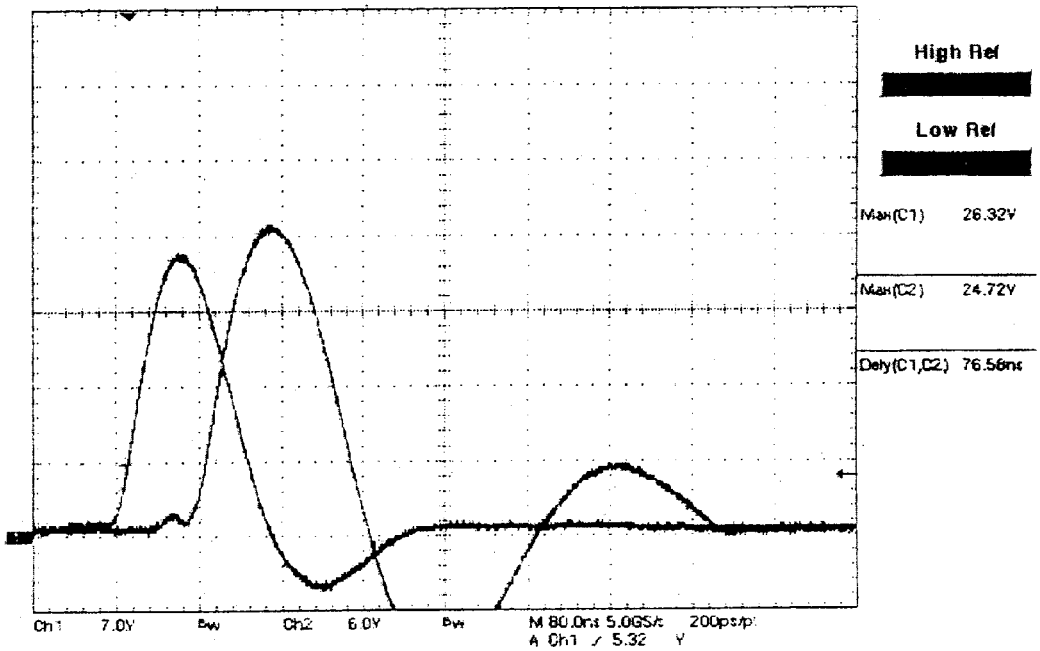
FIG. 6 is a graph showing the rise time of two CDUs discharged into loads in accordance with embodiments of the present invention.

Using the exemplary design shown in FIGS. 3A-3C, a high fidelity output may be achieved as shown in FIG. 6. The output data from two high voltage/high energy CDUs are discharged at high speeds into a 0.250 ohm CVR load through a high speed switch. High fidelity outputs were observed from the CVR loads terminated into a 50 ohm oscilloscope. The waveforms should in FIG. 6 indicate discharge peaks currents of 2600 amps with rise times on the order of 60 nsec.

Embodiments of the present invention also involve conventional manufacturing process for producing a CVR and a load for a CDU.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. A device comprising:

a BNC-PCB connector having a pin for electrically contacting one or more conducting elements of a flat cable, and a current viewing resistor having an opening through which the pin extends and having a resistor face that abuts a connector face of the BNC-PCB connector, wherein the device is a terminal unit for the flat cable.

2. The device of claim 1, wherein the BNC connector is electrically connected to the one or more conducting elements of the flat cable.

3. The device of claim 2, further comprising a folded metal strip resistor that is in electrical communication with the BNC connector, the current viewing resistor and the one or more conducting elements.

4. The device claim 3, further comprising one or more insulating layers interposed between the BNC connector and the current viewing resistor and/or one or more insulating layers interposed between the current viewing resistor and the folded metal strip resistor.

5. The device of claim 1, wherein the current viewing resistor is disc-shaped.

6. The device of claim 1, wherein a BNC portion of the BNC-PCB connector is a male BNC device.

7. The device of claim 1, wherein a BNC portion of the BNC-PCB connector is a female BNC device.

8. A device comprising:

a BNC device comprising a BNC connector mounted on a printed circuit board connector, and the BNC connector having a pin for contacting one or more conducting elements of a flat cable and a load, wherein the load comprises:

a current viewing resistor load having an opening through which the pin extends and having a resistor face that abuts a connector face on the printed circuit board connector; and a folded resistor having a opening for receiving the pin and the folded resistor having a connection to the one or more conducting elements, wherein the printed circuit board connector is connected to a grounding element of the flat cable and wherein the device is a terminal unit for the flat cable.

9. The device 8, wherein the current viewing resistor is substantially disc-shaped.

10. The device of claim 8, further comprising one or more insulating layers interposed between the BNC connector and the current viewing resistor and/or one or more insulating layers interposed between the current viewing resistor and the folded metal resistor.

11. The device of claim 8, wherein the BNC device further comprises a mechanical jacket for engaging a corresponding BNC device.

12. The device of claim 8, wherein when the BNC device is a male BNC device.

13. The device of claim 8, wherein when the BNC device is a female BNC device.

14. The device of claim 8, wherein the opening of the current viewing resistor load is gold plated to connect with the pin.

15. The device of claim 8, wherein the current viewing resistor occupies substantially the entire portion of the connector face.

16. The device of claim 8, wherein the flat cable is connected to a capacitive discharge unit.

* * * * *